US010513928B2

(12) United States Patent
Bruurs

(10) Patent No.: US 10,513,928 B2
(45) Date of Patent: Dec. 24, 2019

(54) AXIAL THRUST BALANCING DEVICE

(71) Applicant: Flowserve Management Company, Irving, TX (US)

(72) Inventor: Kevin Bruurs, Loon op Zand (NL)

(73) Assignee: Flowserve Management Company, Irving, TX (US)

( * ) Notice: Subject to any disclaimer, the term of this patent is extended or adjusted under 35 U.S.C. 154(b) by 86 days.

(21) Appl. No.: 15/691,899

(22) Filed: Aug. 31, 2017

(65) Prior Publication Data

US 2019/0063221 A1 Feb. 28, 2019

(51) Int. Cl.

| | |
|---|---|
| ***F01D 3/04*** | (2006.01) |
| ***F04D 29/051*** | (2006.01) |
| ***F04D 29/053*** | (2006.01) |
| *F01D 5/04* | (2006.01) |
| *F04D 29/28* | (2006.01) |

(52) U.S. Cl.

CPC ..... *F01D 3/04* (2013.01); *F04D 29/051* (2013.01); *F04D 29/053* (2013.01); *F01D 5/04* (2013.01); *F04D 29/284* (2013.01); *F05D 2240/60* (2013.01)

(58) Field of Classification Search

CPC . F01D 3/04; F01D 5/04; F04D 29/053; F04D 29/051; F04D 29/284; F05D 2240/60

See application file for complete search history.

(56) References Cited

U.S. PATENT DOCUMENTS 3,614,181 A * 10/1971 Meeks ..... F16C 32/0417 310/90.5
5,209,652 A * 5/1993 Fischer ..... F04D 29/0413 384/103
5,613,831 A * 3/1997 Liegat ..... F04D 29/041 415/229

(Continued)

FOREIGN PATENT DOCUMENTS

JP 2007085223 A 4/2007
JP 2011202641 A1 10/2011

OTHER PUBLICATIONS

PCT Search Report and Written Opinion for Appl No. PCT/US2018/042464 dated Nov. 27, 2018, 13 pages.

*Primary Examiner* — Carl C Staubach
(74) *Attorney, Agent, or Firm* — Maine Cernota & Rardin

(57) ABSTRACT

An axial thrust balancing mechanism for a rotating shaft apparatus such as a rotary pump provides self-regulating thrust compensation while avoiding contact and wear between rotating and static elements. A rotor fixed to the shaft includes a cylindrical male section proximal to but not extending within a cylindrical female section of a non-rotating stator, such that a gap formed therebetween is varied in width by shaft displacements caused by axial thrusts. Pressurized fluid within the female section applies a thrust-compensating force to the rotor that is controlled by the gap size. The female section is larger in diameter than the male section, thereby preventing any contact therebetween. The disclosed mechanism can be combined with a thrust-com- (Continued)

pensating drum so as to reduce the thrust to a residual level that can be regulated. The rotor and stator can be stepwise varied to provide a plurality of gaps and intermediate chambers therebetween.

12 Claims, 9 Drawing Sheets

(56) References Cited

U.S. PATENT DOCUMENTS

| | | | | |
|---|---|---|---|---|
| 6,255,752 | B1 * | 7/2001 | Werner | F04D 29/048<br>310/90.5 |
| 2008/0181762 | A1 | 7/2008 | Ganelin et al. | |
| 2012/0148384 | A1 | 6/2012 | Boufflert et al. | |
| 2014/0241887 | A1 * | 8/2014 | Neuenschwander | F01D 25/168<br>416/174 |
| 2017/0130730 | A1 * | 5/2017 | Torkildsen | F04D 29/051 |
| 2017/0130737 | A1 * | 5/2017 | Nagai | F04D 29/42 |
| 2017/0350252 | A1 * | 12/2017 | Wengert | F01D 3/04 |
| 2018/0030992 | A1 * | 2/2018 | Masutani | F04D 17/125 |
| 2018/0355879 | A1 * | 12/2018 | Huber | F04D 29/126 |

* cited by examiner

AXIAL THRUST BALANCING DEVICE

FIELD OF THE INVENTION

The invention relates to rotating shaft devices, and more particularly, to thrust balancing mechanisms in rotating shaft devices.

BACKGROUND OF THE INVENTION

It is typical in rotating shaft devices, and especially in impeller driven pumps, for pressure differences to be developed within the mechanism that result in axially directed forces, generally referred to as "thrust," being applied to the rotating shaft. For example, in a centrifugal pump, the impeller (or each impeller) will tend to produce some amount of thrust because of different pressures and different geometries on the two sides of the impeller.

In some cases, these axial thrust forces are opposed and absorbed by the bearings that support the rotating shaft. However, it can be undesirable to require that the bearings absorb all of the thrust that is generated by the impellers. For example, in a high pressure multistage pump the net thrust that is generated may cause unacceptable wear to the bearings unless it is compensated in some manner. Accordingly, it is often desirable to include a mechanism within a rotating shaft device that will compensate for thrust effects by generating an offsetting thrust, thereby reducing or eliminating the thrust compensating load that is placed on the bearings Thrust that arises in a multi-stage rotary pump can sometimes be offset, for example in axial split pumps, by including an even number of stages, and by orienting the impellors in opposite directions, such that the thrust developed by one half of the pump stages is offset by an approximately equal and opposite thrust developed by the other half of the pump stages. However, it is not always practical to balance axial thrust by using opposed impellers, especially for pumps such as barrel pumps that operate at high pressures. Furthermore, even for pumps with opposed impellors the innermost impellor stages will tend to create a net axial thrust that depends on the pressure within the pump.

Another approach that is used for thrust compensation is to include a balancing "disk." A simplified example is presented in the cross-sectional illustration of FIG. 1, in which an impellor 100 is fixed to a rotating shaft 102. In this example, process fluid that leaks past the impellor 100 is collected behind the impellor 100 in a leakage chamber 104 formed between the shaft 102 and the pump housing 106. One end of the leakage chamber 104 is bounded by a thrust-balancing "disk" 108, which is fixed to the shaft 100.

The balancing disk 108 is configured such that a narrow, axial gap 110 is formed between the outer perimeter of the disk 108 and the pump housing 106. Leakage fluid is able to flow through this "pressure relief" gap 110 at a limited rate into a collection chamber 112 which is in fluid communication with the pump inlet. According to this configuration, the fluid pressure in the collection chamber 112 is approximately equal to the inlet pressure, while the fluid pressure in the leakage chamber 104 is higher than the inlet pressure. As a result, a compensating thrust 116 is applied to the balancing disk 108 that is in opposition to the axial thrust 114 generated by the impellor 100.

If the compensating thrust 116 is less than the impellor thrust 114, the rotating shaft 100 is axially shifted to the right, causing the pressure relief gap 110 to be narrowed, and raising the pressure in the leakage chamber 104, thereby increasing the balancing thrust 116. Conversely, if the balancing thrust 116 is greater than the impellor thrust 114, then the shaft 100 is axially shifted to the left and the pressure relief gap 110 is enlarged, thereby reducing the pressure in the leakage chamber 104. The result is a self-regulating effect that can maintain the axial thrust at a very low level, which can approach zero net thrust, because the compensating thrust reacts directly to the axial shifting of the rotating shaft 100, which is caused by the residual axial thrust.

It is clear from FIG. 1 that the radial pressure relief gap 110 is critical to the thrust compensation. Unfortunately, for some pump designs there can be physical contact between the balancing disk 108 and the housing 106, for example during pump startup and/or due to unexpected fluctuations in pump speed. Accordingly a balancing disk is not always a suitable approach for axial thrust compensation.

Another approach that is sometimes used for thrust compensation, for example when a wide range of operating speeds is anticipated and/or where there may be transient fluctuations in the pump speed, is to include a balancing "drum." A simplified example is illustrated in FIG. 2.

In the example of FIG. 2, the leakage chamber 104 behind the impellor 100 is terminated at one end by a so-called balancing "drum" 200, which differs from the balancing disk 108 of FIG. 1 mainly in that it is separated from the housing 106 by a radial gap 202 instead of an axial gap 110. In the example of FIG. 2, a compensating thrust 116 is created essentially by the same mechanism as for the balancing disk 108 of FIG. 1. The primary difference is that the gap 202 does not vary in size as a function of axial shaft position, so that there is no "self-regulation" of the thrust compensation. Instead, the fluid pressure in the leakage chamber 104 tends to remain at a fixed percentage of the impellor outlet pressure. The advantage of the balancing drum approach is that there is little or no danger of contact and wear between the drum 200 and the housing 106. The disadvantage is that a balancing drum does not respond directly to changes in axial position of the shaft, and as a result the residual thrust 114 will tend to vary over a wider range than for a balancing disk, especially if the pump is operated at varying speeds. Accordingly, the bearings can be required to absorb greater residual thrusts than in the case of a balancing disk.

What is needed, therefore, is an axial thrust balancing mechanism that provides a self-regulating and potentially near-complete balancing of the axial thrust in a rotating shaft system, while avoiding any possibility of contact and wear between the balancing mechanism and the apparatus housing.

SUMMARY OF THE INVENTION

An axial thrust balancing mechanism for a rotating shaft apparatus is disclosed that provides self-regulating thrust compensation, similar to a balancing disk, and is thereby able to provide nearly complete cancellation of axial thrust, while at the same time avoiding virtually any possibility of contact and wear between rotating and static elements of the balancing mechanism. The disclosed device is referred to herein as a "hybrid" balancing mechanism because it combines features of balancing disks and balancing drums. The device is applicable to any rotating shaft apparatus that is subject to axial thrust, including but not limited to turbo pumps, compressors, turbines, and turbochargers.

Specifically, the disclosed hybrid mechanism includes a rotor element that is fixed to the rotating shaft and a corresponding stator element that is integral with or fixed to the housing. The rotor and stator are configured in a manner that is similar to the housing 106 and drum 200 of FIG. 2, in that rotor is coaxial with the stator and of smaller diameter. However, unlike the balancing drum of FIG. 2, according to the present invention the rotor is positioned adjacent to the stator, rather than within the stator. As a result, during normal operation the pressure relief gap that is formed between the rotor and stator is neither horizontal nor vertical, but instead varies in both direction and size as the shaft is axially shifted by applied thrusts.

Accordingly, a feedback effect is established by the disclosed mechanism that is similar to the feedback provided by a thrust compensation disk such as FIG. 1. However, the disclosed mechanism does not pose any danger of direct axial contact between the rotor and stator, because the rotor is smaller in diameter than the stator. As a result, if the rotating shaft is displaced by a large offset, the rotor will simply enter into the interior of the stator, and will function much like the compensating drum of FIG. 2.

In some embodiments the disclosed mechanism is the only thrust compensation that is provided, and in some of these embodiments, the disclosed mechanism compensates for at least 90% of the thrust that is developed by the impeller or other shaft-mounted apparatus. In other embodiments, a more conventional compensating drum is included in the apparatus, and is configured to compensate for a significant fraction of the total thrust, so that the disclosed hybrid mechanism is required only to compensate for the residual thrust that is not compensated by the drum.

In embodiments, fluid flowing from the leakage chamber to the collection chamber is required to flow through a plurality of pressure relief gaps. In embodiments, this approach increases the feedback effect, by enhancing the changes in leakage chamber pressure as a function of axial movement of the shaft.

The present invention is a thrust regulating mechanism for an apparatus having a shaft that is subject to an axial displacement caused by an axial thrust. The mechanism comprises a first segment that is longitudinally fixed to and coaxial with the rotatable shaft, and a second segment that surrounds but is not longitudinally fixed to the shaft, the first and second segments being configured such that there is a relative rotation therebetween during operation of the apparatus, the second segment being in fluid communication with a high pressure fluid region, a cylindrical male section included on one of the first and second segments, and a cylindrical female section included on the other of the first and second segments, the male section being terminated by a circular leading edge and the female section being terminated at a front edge thereof by a circular opening that is larger in diameter than circular leading edge of the male section, the leading edge of the male section being proximal to the front edge of the female section without entering into the female section, so that a pressure release gap is formed between the leading edge of the male section and the front edge of the female section through which pressurized fluid is able to flow from the second segment, past the first segment, to a low pressure region, while an axial compensating force opposed to said axial thrust is applied to the first segment by the pressurized fluid, said pressure release gap being reduced in size by said axial displacement, such that the compensating force is increased when the axial thrust and axial displacement are increased, and the size of the pressure release gap is consequently decreased.

In various embodiments, the apparatus is a compressor or a turbine, a pump rotating as a turbine, a turbo pump, or a multi-stage turbo pump.

In any of the above embodiments, the female section can be configured so as to be filled with fluid that leaks past an impeller of the turbo pump.

In any of the above embodiments, the low pressure region can be a fluid inlet region of the apparatus.

In any of the above embodiments, the apparatus can further include a thrust reducing drum mechanism that is configured to oppose but not eliminate the axial thrust, said drum mechanism comprising a cylindrical drum section configured to rotate within and relative to a non-rotating passage, a radial gap being formed between the drum and passage having a radial gap size that is independent of said axial displacement, one but not both of said drum and passage being longitudinally fixed to the shaft, a residual axial thrust that is not compensated by the drum mechanism being regulated by the thrust regulating mechanism.

In any of the above embodiments, the apparatus can includes a plurality of male sections and a corresponding plurality of female sections, leading and front edges of the corresponding male and female sections being proximal to each other so as to form a plurality of gaps and intermediate chambers that the pressurized fluid traverses as it flows from the high pressure fluid region to the low pressure region, each of the plurality of gaps having a size that is reduced by the axial displacement of the rotatable shaft.

And in any of the above embodiments, the mechanism can be configured such that a magnitude of the compensating force will rise to at least 90% of a magnitude of the axial thrust before the male section of the rotor enters the female section of the stator.

The features and advantages described herein are not all-inclusive and, in particular, many additional features and advantages will be apparent to one of ordinary skill in the art in view of the drawings, specification, and claims. Moreover, it should be noted that the language used in the specification has been principally selected for readability and instructional purposes, and not to limit the scope of the inventive subject matter.

DETAILED DESCRIPTION

An axial thrust balancing mechanism for a rotating shaft apparatus is disclosed that provides self-regulating thrust compensation, similar to a balancing disk, and is thereby able to provide complete or nearly complete cancellation of axial thrust, while at the same time avoiding virtually any possibility of contact and wear between rotating and static elements of the balancing mechanism. The disclosed device is referred to herein as a "hybrid" balancing mechanism, because it combines advantages associated with balancing disks (self-regulating thrust compensation) and balancing drums (axial contact between the rotating and static elements is impossible) into a single mechanism. The device is applicable to any rotating shaft apparatus that is subject to axial thrust, including but not limited to turbo pumps, compressors, turbines, and turbochargers.

Figure 3A:
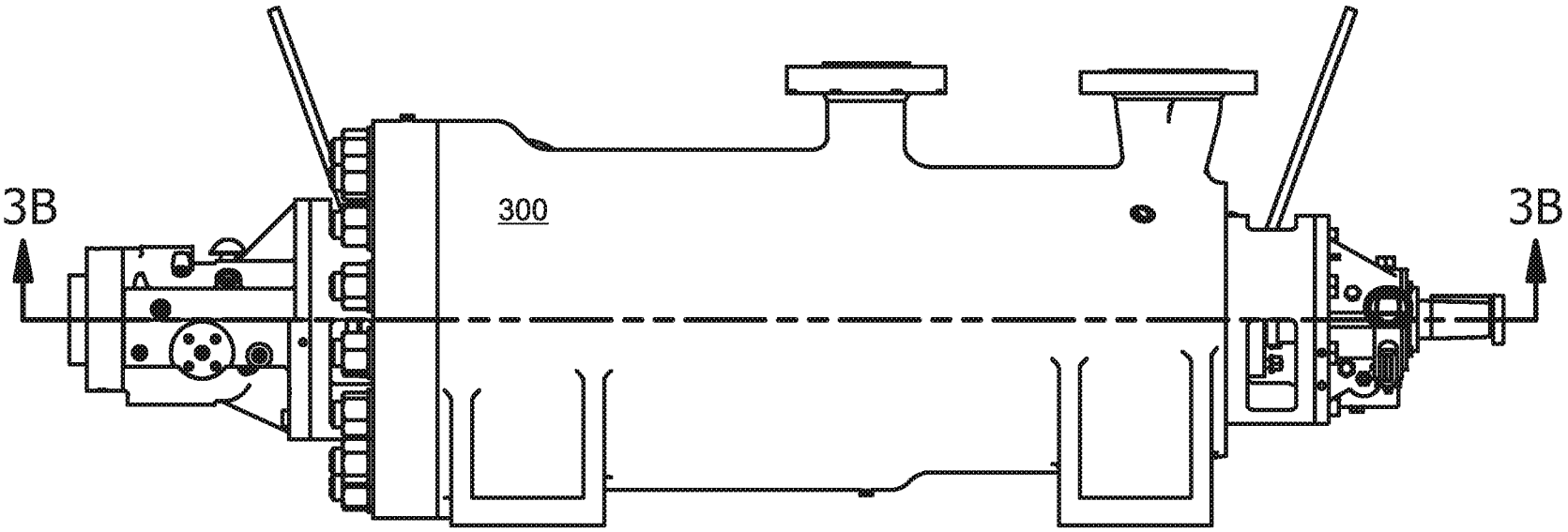
FIG. 3A is a side view of a rotary pump to which embodiments of the present invention are applicable.
Figure 3B:
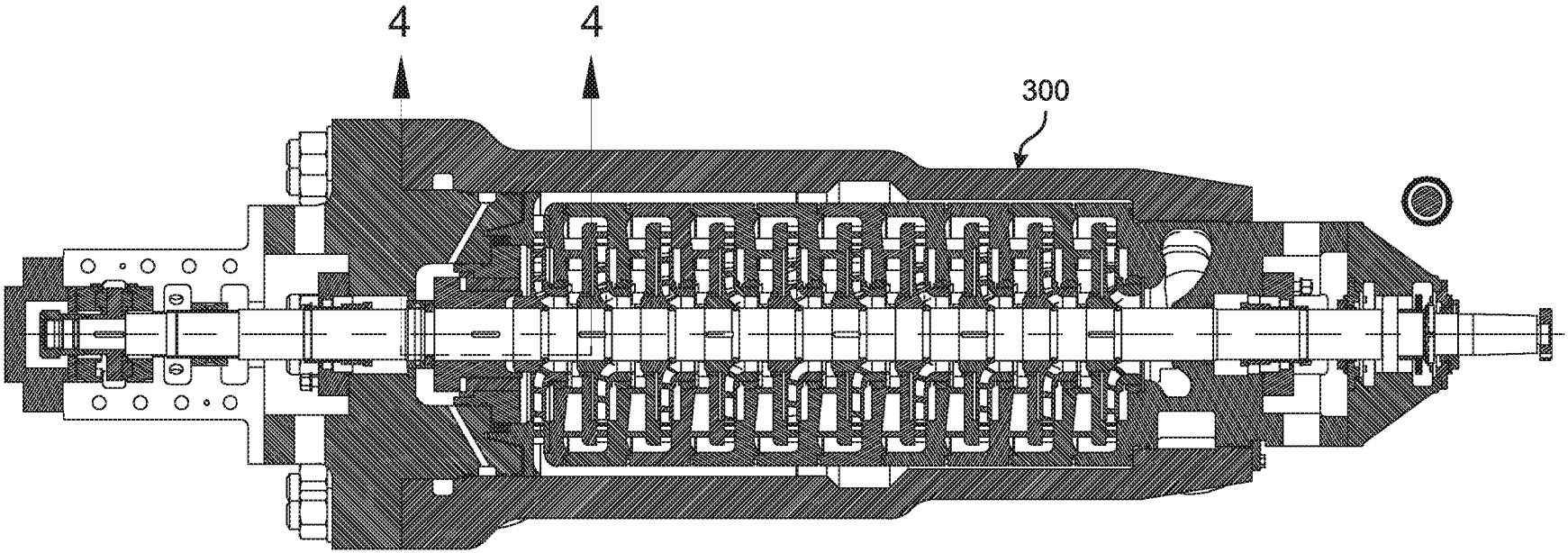
FIG. 3B is a sectional view of the pump of FIG. 3A.
Figure 4:
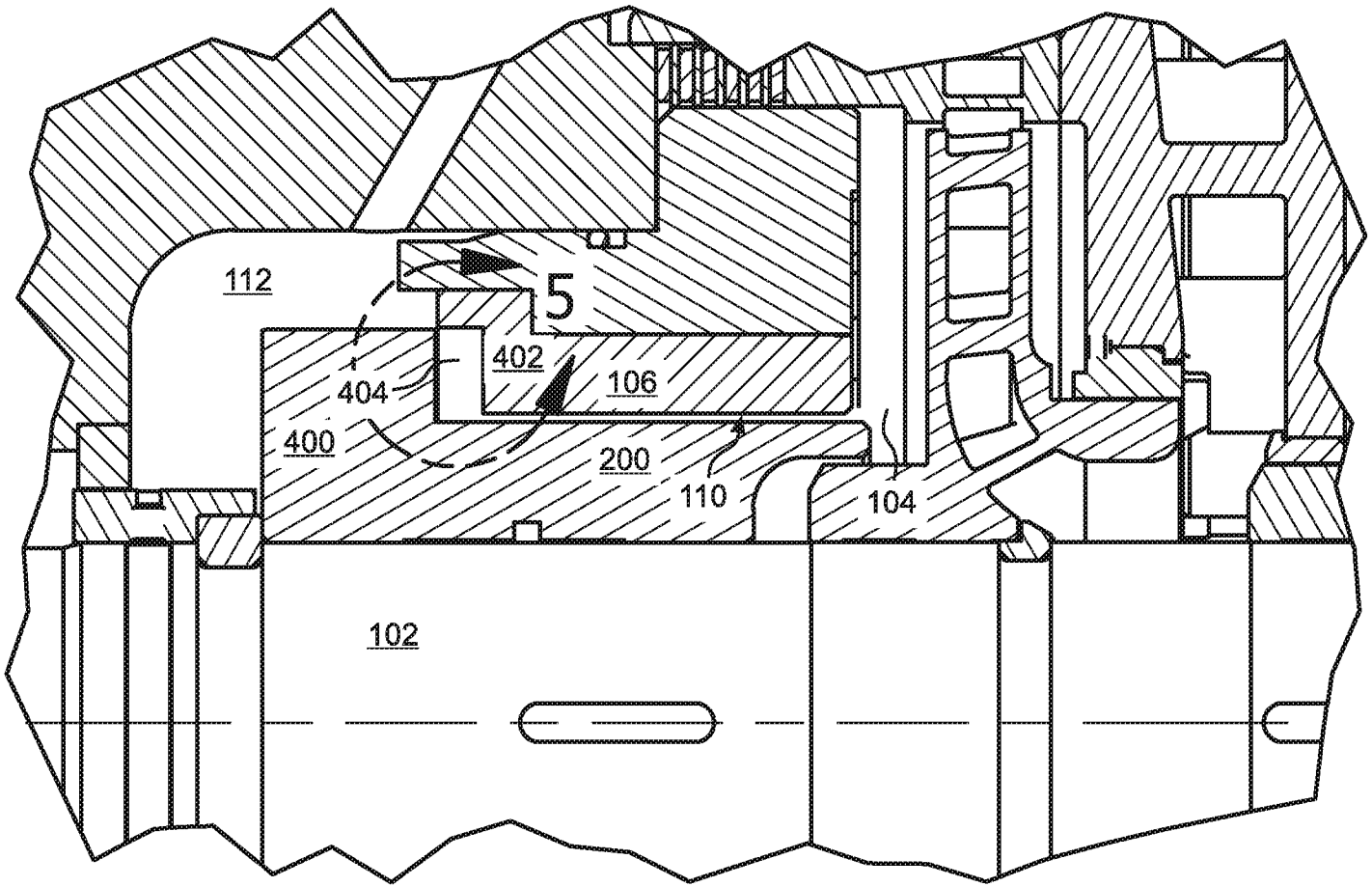
FIG. 4 is a magnified cross-sectional view of a region of the pump of FIG. 3B where an embodiment of the present invention is implemented.

FIG. 3A is a side view of a multi-stage rotary pump in which an embodiment of the present invention is included. FIG. 3B is a sectional view of the pump of FIG. 3A, where the plurality of impeller stages is clearly visible. FIG. 4 is an enlargement of the region behind the final impellor stage in the region indicated in FIG. 3B. It can be seen in FIG. 4 that the disclosed embodiment includes a balancing drum section that is formed by a first region 200 of the rotor element that is contained within a first region 106 of the stator element. In addition, the embodiment includes a hybrid balancing section including a second region 400 of the rotor element that is smaller in diameter but located just outside of a corresponding region 402 of the stator element, such that an intermediate chamber 404 is formed within the second region 402 of the stator element wherein fluid can be collected. The area that is circled in FIG. 4 is enlarged in FIG. 5.

Figure 2:
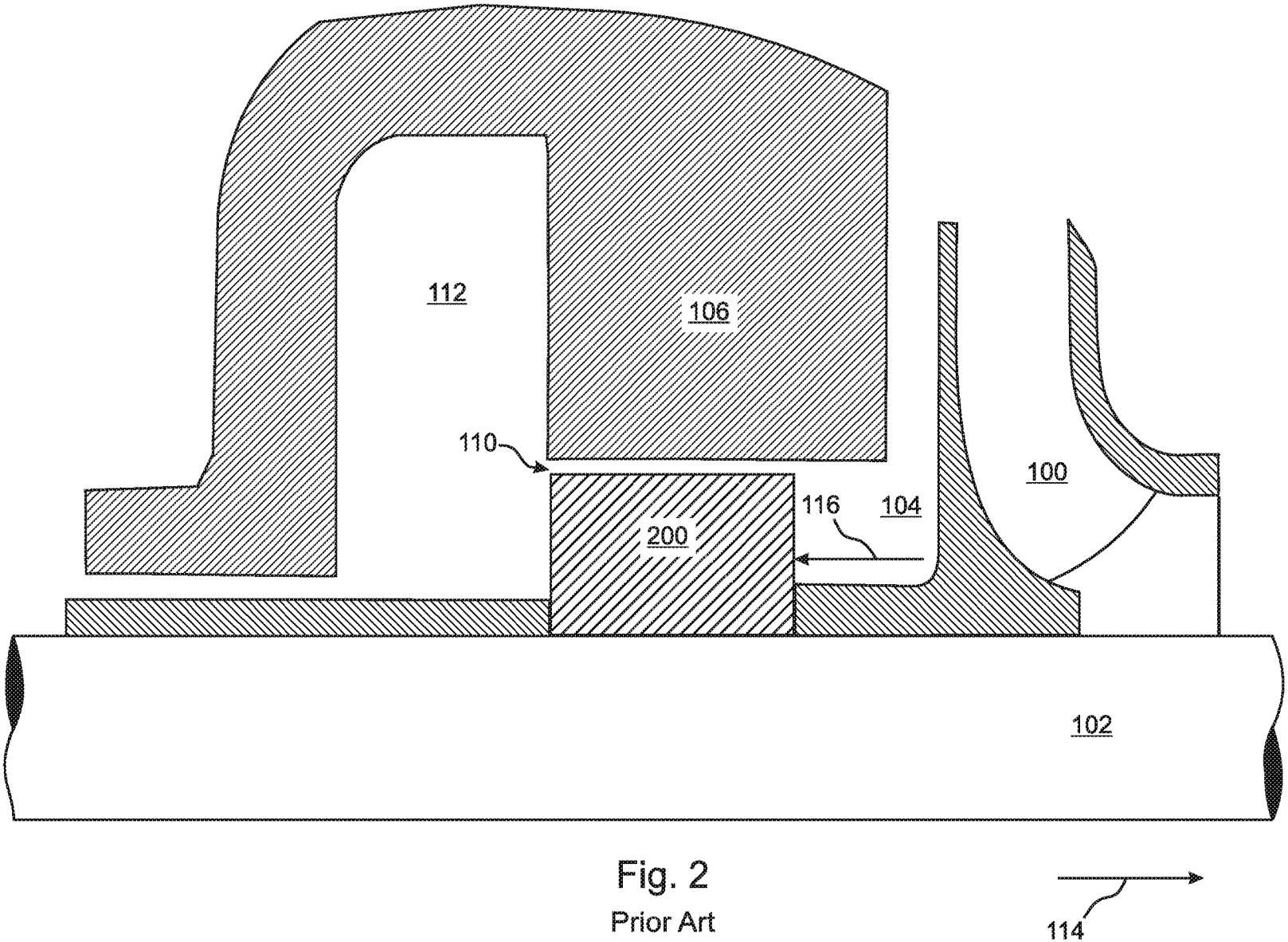
Fig. 2 Prior Art
FIG. 2 is a simplified cross sectional illustration of a thrust compensating drum of the prior art.
Figure 5:
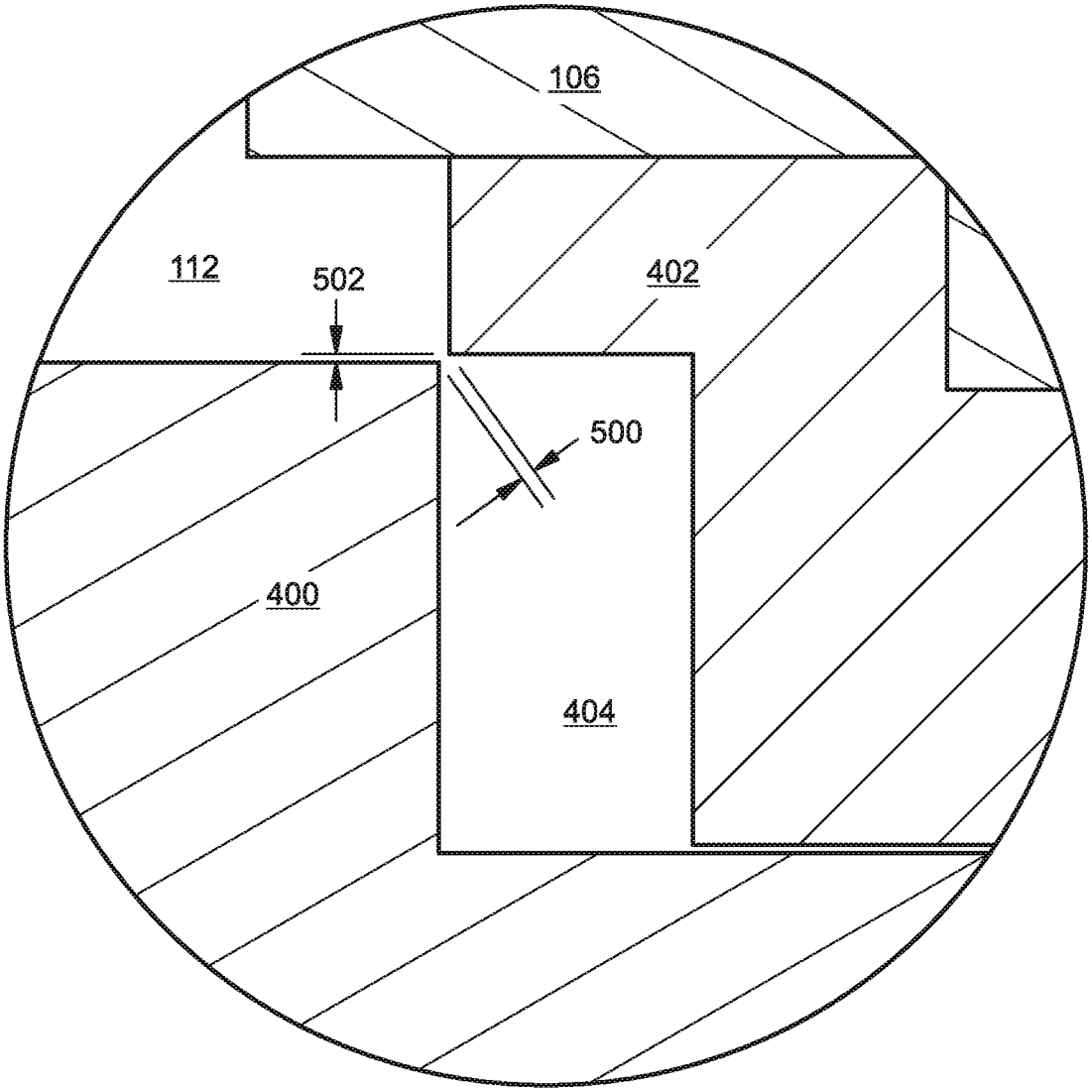
FIG. 5 is a magnified cross-sectional view of the embodiment of FIG. 4, shown in a low-thrust configuration.

With reference to FIG. 5, the rotor 400 and stator 402 elements are configured such that the rotor element 400 is coaxial with the stator element 402 and of smaller diameter. This difference in diameters 502 represents a minimum gap 502 between the rotor 400 and stator 402 elements. However, unlike the balancing drum 200 of FIG. 2, according to the present invention the rotor element 400 is positioned adjacent to the stator element 402, rather than within the stator element 402. As a result, during normal operation the pressure relief gap 500 that is formed between the rotor and stator elements in this region is neither horizontal nor vertical, but instead varies in both direction and size as the shaft 102 is axially shifted by applied axial thrust.

Figure 6:
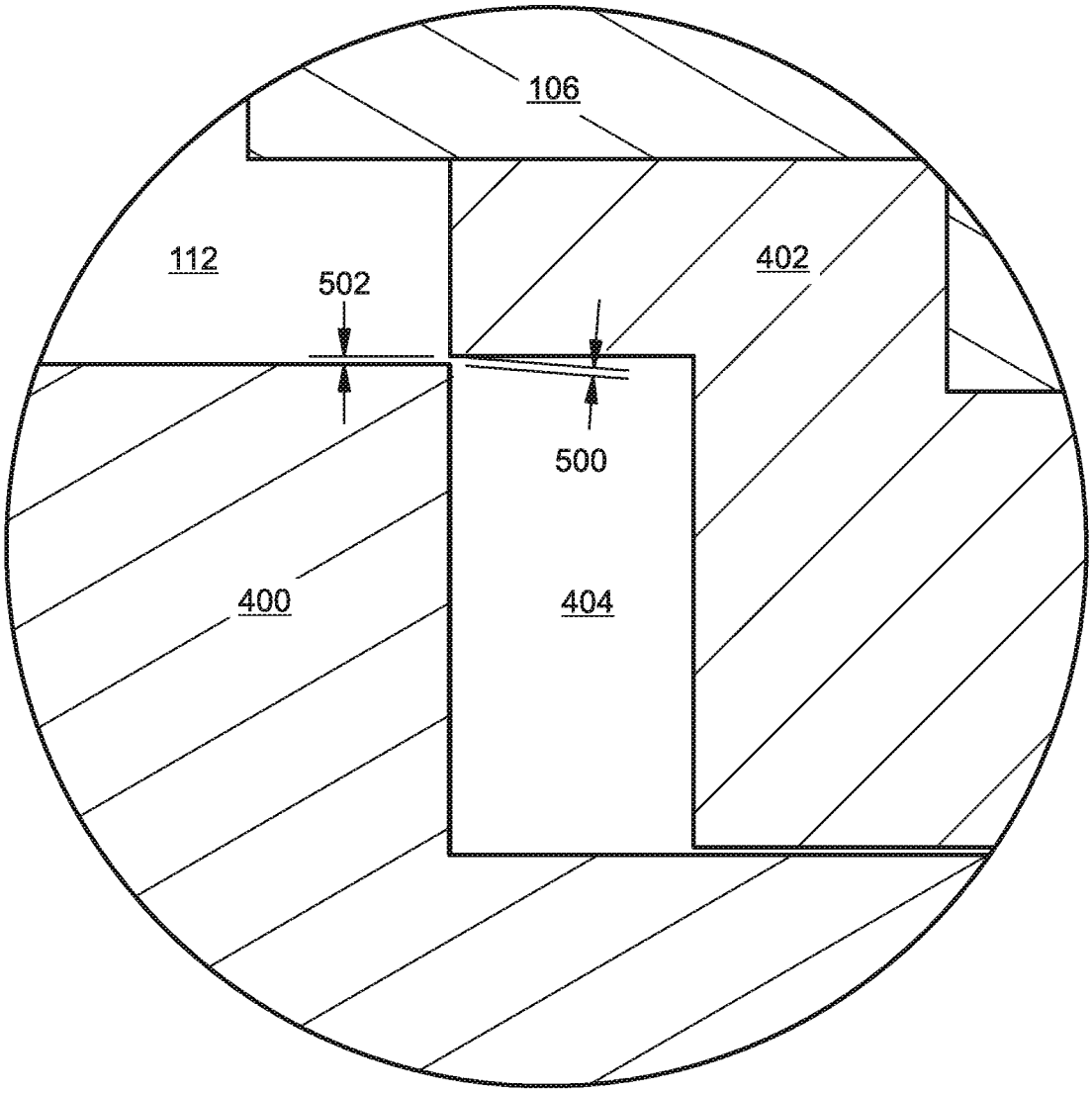
FIG. 6 is a magnified cross-sectional view of the embodiment of FIG. 4, shown in a high-thrust configuration.

In FIG. 5, the thrust is relatively low, causing the rotor element 400 to be spaced apart from the stator element 402 such that the effective pressure relief gap 500 between the intermediate chamber 404 and the collection chamber 112 is tipped at an angle of approximately 55 degrees from horizontal. In FIG. 6, the thrust has been increased, causing the shaft 102 to shift to the right, thereby narrowing the gap 500 and shifting its direction closer to horizontal. Because the gap 500 is narrower, the pressure difference across the rotor 400 is increased, thereby compensating for the increased thrust. In embodiments, the angle of the pressure relief gap 500 can vary between zero degrees and 70 degrees, depending on the axial thrust and resulting displacement of the shaft.

Figure 1:
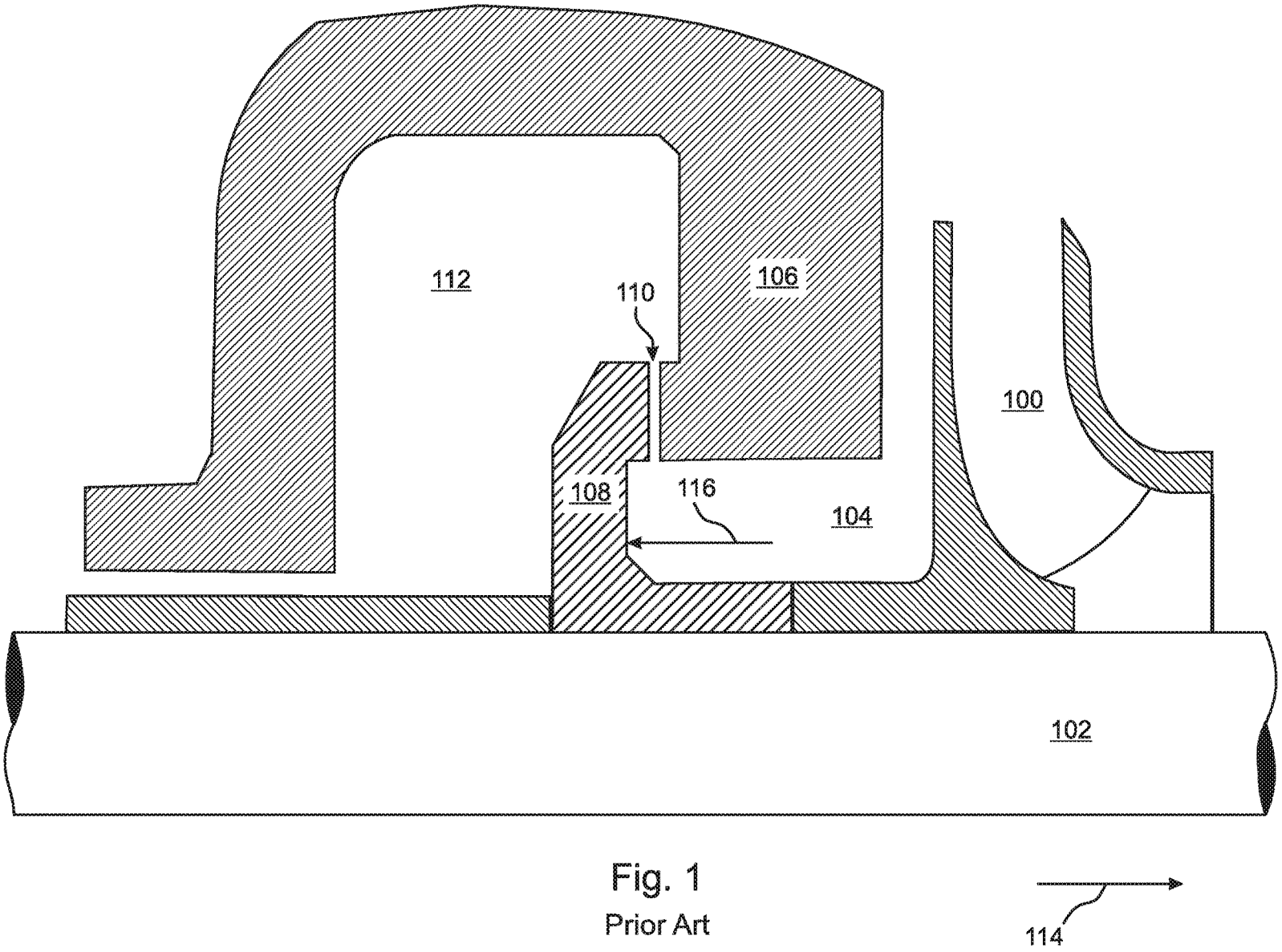
Fig. 1 Prior Art
FIG. 1 is a simplified cross sectional illustration of a thrust compensating disk of the prior art.

Accordingly, a feedback effect is established by the disclosed thrust compensation mechanism that is similar to the feedback provided by a thrust compensation disk such as FIG. 1. However, the disclosed mechanism does not pose any danger of direct contact between the rotor element 400 and stator element 402, because the rotor element 400 is smaller in diameter than the stator element 402, such that there is a minimum gap 500 that is always maintained between them. If the rotating shaft 102 is displaced by a large offset, the rotor element 400 will simply enter into the interior of the stator element 402, and will function much like the compensating drum 200 of FIG. 2.

As discussed above, the embodiment of FIGS. 4-6 combines a balancing drum (106, 200, 110) with a hybrid balancing mechanism (402, 400, 404) of the present invention. Accordingly, fluid collected in the leakage chamber 104 is required to flow through the drum gap 110 before reaching the intermediate chamber 404. The fluid then flows through the angled gap 500 before reaching the collection chamber 112. In general, the drum gap 110 and the minimum rotor/stator clearance 502 of the hybrid balancing section can be the same size or different sizes, depending on the requirements of the embodiment.

In some embodiments the disclosed hybrid balancing mechanism is the only thrust compensation that is provided, and in some of these embodiments, the disclosed mechanism compensates for at least 90% of the thrust that is developed by the impeller or other shaft-mounted apparatus.

Figure 7:
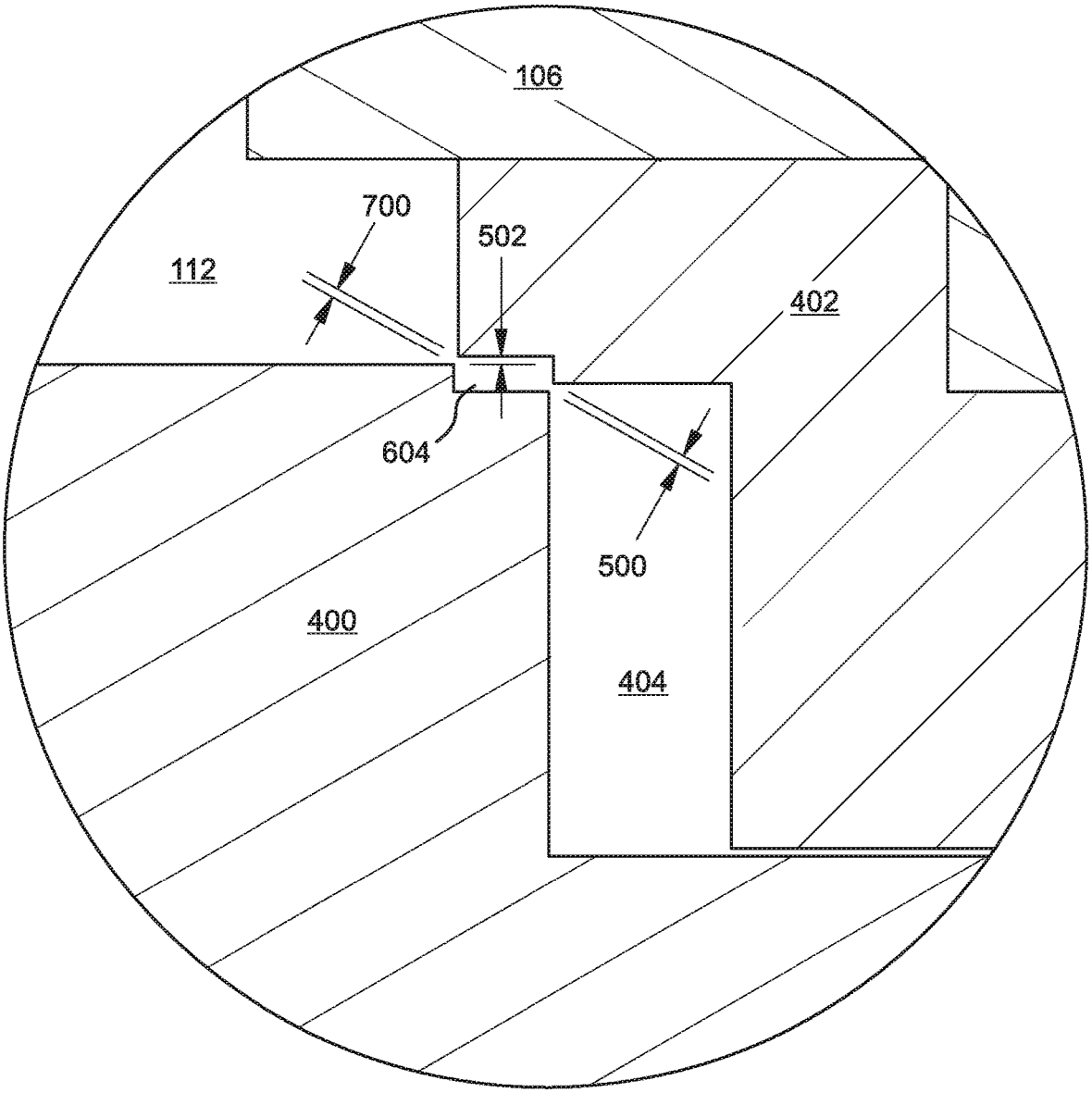
FIG. 7 is a cross-sectional view of an embodiment that includes step-wise rotor and stator regions that form two pressure relief gaps with an intermediate chamber therebetween.

In the embodiment of FIG. 7, the fluid flowing from the leakage chamber 104 to the collection chamber 112 is required to flow through a first variable angle gap 500 and into an intermediate chamber 604 before flowing through a second variable angle gap 700 and into the collection chamber 112. In embodiments, this approach increases the feedback effect of the disclosed mechanism, by enhancing the changes in leakage chamber pressure as a function of axial movement of the shaft 102. In a similar manner, various embodiments include three or more variable gaps and intermediate chambers.

Figure 8:
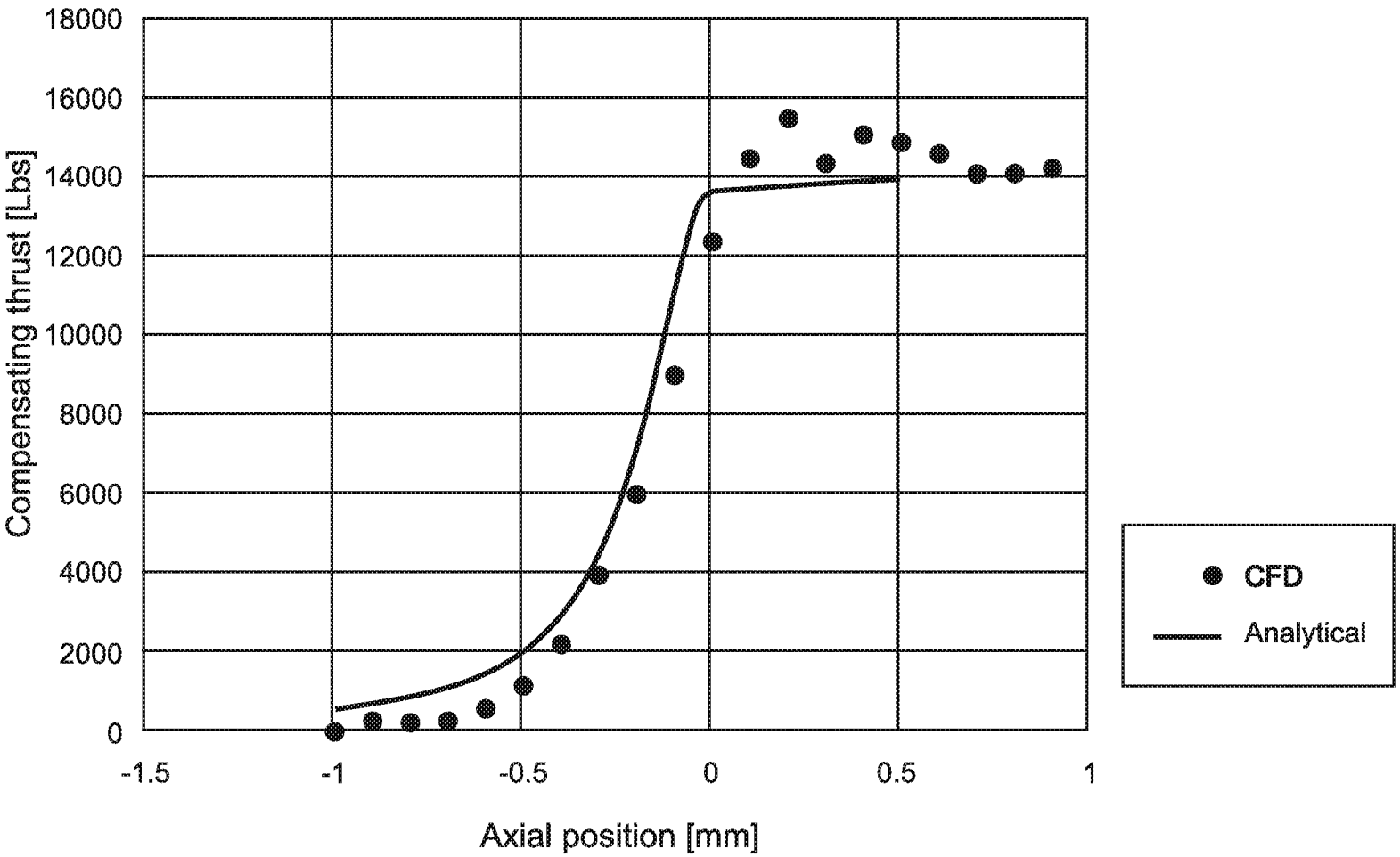
FIG. 8 is a graph of compensating thrust as a function of axial shaft position in an embodiment of the invention, where the graph compares points generated by computational fluid dynamics with an analytical curve.

FIG. 8 is a plot of simulated "CFD" (computational fluid dynamics) data points and an analytical model illustrating the compensating thrust provided by an embodiment as a function of axial position of the rotating shaft 102. It can be seen that in this specific application, when the axial position is in the steepest region of the curve, a shift of the axial position of only 0.1 mm results in a change in the compensating thrust of approximately 2000 pounds. It should be noted, however, that these quantities will vary considerably depending on the specific application.

The foregoing description of the embodiments of the invention has been presented for the purposes of illustration and description. Each and every page of this submission, and all contents thereon, however characterized, identified, or numbered, is considered a substantive part of this application for all purposes, irrespective of form or placement within the application.

The invention illustratively disclosed herein suitably may be practiced in the absence of any element which is not specifically disclosed herein and is not inherently necessary. However, this specification is not intended to be exhaustive. Although the present application is shown in a limited number of forms, the scope of the invention is not limited to just these forms, but is amenable to various changes and modifications without departing from the spirit thereof. One of ordinary skill in the art should appreciate after learning the teachings related to the claimed subject matter contained in the foregoing description that many modifications and variations are possible in light of this disclosure. Accordingly, the claimed subject matter includes any combination of the above-described elements in all possible variations thereof, unless otherwise indicated herein or otherwise clearly contradicted by context. In particular, the limitations presented in dependent claims below can be combined with their corresponding independent claims in any number and in any order without departing from the scope of this disclosure, unless the dependent claims are logically incompatible with each other.

What is claimed is:

1. An apparatus comprising:

a housing;

at least one impellor fixed to a shaft that is rotatable within the housing, said at least one impellor and shaft being subject to an axial displacement caused by an axial thrust;

a thrust compensating mechanism that is distinct and separated from all impellors that are fixed to said shaft, said thrust compensating mechanism including:

a first segment that is longitudinally and rotationally fixed to and coaxial with the rotatable shaft; and a second segment that surrounds the rotatable shaft while being longitudinally and rotationally fixed to the housing;

one of the first and second segments being a male segment having a first cylindrical outer surface that is terminated by a first circular leading edge;

the other of the first and second segments being a female segment containing a first cylindrical passage, said first cylindrical passage being terminated at a front face of the female segment by a first circular opening that is larger in diameter than the first circular leading edge of the male segment, when the shaft is not axially displaced, said first circular leading edge of the male segment being proximal to the first circular opening of the female segment without entering into the first cylindrical passage of the female segment, so that a first pressure release gap is formed between the first leading edge of the male segment and the first circular opening of the female segment through which pressurized fluid is able to flow from a high pressure region to a first lower pressure region, whereby an axial compensating force opposed to said axial thrust is applied to the first segment by the pressurized fluid, said first pressure release gap being reduced in size by said axial displacement, such that the compensating force is increased when the axial thrust and axial displacement are increased, and the size of the pressure release gap is consequently decreased.

2. The apparatus of claim 1, wherein the apparatus is a compressor.

3. The apparatus of claim 1, wherein the apparatus is a turbine.

4. The apparatus of claim 1, wherein the apparatus is a pump rotating as a turbine.

5. The apparatus of claim 1 wherein the apparatus is a turbo pump.

6. The apparatus of claim 5, wherein the apparatus is a multi-stage turbo pump.

7. The apparatus of claim 5, wherein the female segment is configured so as to be filled with fluid that leaks past an impeller of the turbo pump.

8. The apparatus of claim 1, wherein the low pressure region is a fluid inlet region of the apparatus.

9. The apparatus of claim 1, wherein the apparatus further comprises a thrust reducing drum mechanism that is configured to oppose but not eliminate the axial thrust, said drum mechanism comprising a cylindrical drum section configured to rotate within and relative to a non-rotating passage, a radial gap being formed between the drum and passage having a radial gap size that is independent of said axial displacement, one but not both of said drum and passage being longitudinally fixed to the shaft, a residual axial thrust that is not compensated by the drum mechanism being regulated by the thrust regulating mechanism.

10. The apparatus of claim 1, wherein:

said male element further comprises a second cylindrical outer surface that is terminated by a second circular leading edge, said second cylindrical outer surface being smaller in diameter than said first cylindrical outer surface, said second cylindrical outer surface extending into said first cylindrical passage of the female element; and said female element further contains a second cylindrical passage extending inward from said first cylindrical passage, said second cylindrical passage being terminated at the first cylindrical passage by a second circular opening that is smaller in diameter than the first circular opening but larger in diameter than the second circular leading edge of the male segment;

when the shaft is not axially displaced, said second circular leading edge of the male segment being proximal to the second circular opening of the female segment without entering into the second cylindrical passage of the female segment, so that a second pressure release gap is formed between the second leading edge of the male segment and the second circular opening of the female segment through which the pressurized fluid is able to flow from the first lower pressure region to a second lower pressure region, said second lower pressure region being lower in fluid pressure than said first lower pressure region, said second pressure release gap being reduced in size by said axial displacement:

wherein the pressurized fluid sequentially traverses the first and second pressure release gaps as it flows from the high pressure region to the second lower pressure region.

11. The apparatus of claim 1, wherein the apparatus is configured such that a magnitude of the compensating force will rise to at least 90% of a magnitude of the axial thrust before the circular leading edge of the male segment enters the cylindrical passage of the female segment.

12. The apparatus of claim 1, wherein the male segment is smaller in diameter than all of the impellors that are fixed to the shaft.

* * * * *